US005603677A

United States Patent [19]

Sollo

[11] Patent Number: 5,603,677

[45] Date of Patent: Feb. 18, 1997

[54] WEIGHT ASSISTED REHABILITATION SYSTEM

[76] Inventor: Robert E. Sollo, 1132 Ocean Ave., New London, Conn. 06320

[21] Appl. No.: 412,146

[22] Filed: Mar. 28, 1995

[51] Int. Cl.[6] ..... A61H 3/04

[52] U.S. Cl. ..... 482/69; 135/67; 606/241; 601/23

[58] Field of Search ..... 482/23, 43, 68, 482/69, 67, 143, 95; 602/32–36; 606/241; 601/23; 5/81.1, 83.1, 84.1, 85.1; 297/275, DIG. 10; 135/67, 71, 72

[56] References Cited

U.S. PATENT DOCUMENTS

| | | | |
|---|---|---|---|
| 2,109,188 | 2/1938 | Bajanova . | |
| 2,625,202 | 1/1953 | Richardson et al. | 482/69 |
| 2,665,685 | 1/1954 | Kaufman . | |
| 2,719,568 | 10/1955 | Webb | 482/69 |
| 2,830,581 | 4/1958 | Sanders . | |
| 3,003,498 | 10/1961 | Hotas . | |
| 3,195,550 | 7/1965 | Ingalls et al. | 135/67 |
| 3,252,704 | 5/1966 | Wilson | 482/69 |
| 3,422,830 | 1/1969 | Cherup | 135/67 |
| 3,711,877 | 1/1973 | Averill . | |
| 3,999,228 | 12/1976 | Thomas . | |
| 4,248,256 | 2/1981 | Thomas | 135/67 |
| 4,341,381 | 7/1982 | Norberg | 135/67 |
| 4,431,184 | 2/1984 | Lew et al. | 482/43 |
| 4,644,595 | 2/1984 | Daniel . | |
| 5,020,560 | 6/1991 | Turbeville | 135/67 |
| 5,064,191 | 11/1991 | Johnson | 482/143 |
| 5,184,992 | 2/1993 | Banks | 482/98 |
| 5,187,822 | 2/1993 | Merry . | |
| 5,273,502 | 12/1993 | Kelsey et al. | 482/69 |
| 5,305,773 | 4/1994 | Browning | 135/67 |
| 5,333,333 | 8/1994 | Mah | 5/81.1 |
| 5,372,561 | 12/1994 | Lynch | 482/74 |
| 5,378,215 | 1/1995 | Harkins | 135/67 |

FOREIGN PATENT DOCUMENTS

| | | | |
|---|---|---|---|
| 2170112 | 7/1986 | United Kingdom | 606/241 |
| 9314733 | 8/1993 | WIPO | 135/67 |

*Primary Examiner*—Richard J. Apley
*Assistant Examiner*—Jeanne M. Clark
*Attorney, Agent, or Firm*—Albert W. Hilburger

[57] ABSTRACT

A physical rehabilitation system is provided for improving the capability of a user to support the weight of the user's body on the user's limbs. The system comprises a walker frame capable of gliding movement across a surface, upper limb holding members on the walker frame adapted for engagement by the hands or arms of the user, and counterbalance weights on the walker frame releasably attachable to the user's body for assistance in lifting the user's body to an upright position. The counterbalance weights may be adjustable according to the need of the user. The width of the walker frame, of the upper limb holding members, and the height of the upper limb holding members are all adjustable to accommodate the size of the user. While the user is provided with a range of freedom with respect to the counterbalance weights, a safety limit is provided for restraining and supporting the user in the event of a fall. The walker frame is preferably of the wheeled variety and selectively operable brake devices are provided at each wheel for holding the walker frame immobile.

20 Claims, 2 Drawing Sheets

WEIGHT ASSISTED REHABILITATION SYSTEM

BACKGROUND OF THE INVENTION

1. Field of the Invention

This invention relates generally to apparatus for rehabilitating a person who has experienced, either by accident, by disease, or genetically, a reduction in the normal function of the either the lower limbs and/or upper body. More particularly, the apparatus of the invention serves to aid the user in efforts to regain the functioning of his or her lower limbs and/or upper body at a rehabilitation rate chosen by that individual. The apparatus of the invention is also of benefit for exercising the back and arms of the user.

2. Description of the Prior Art

The following U.S. patents are typical of known constructions of traction apparatus employed for stretching the spinal column of a human patient for therapeutical treatment. In each instance, the body is rendered immobile and weights are applied. They are: U.S. Pat. No. 3,003,498 to Hotas which issued Oct. 10, 1961; U.S. Pat. No. 2,830,581 to Sanders which issued Apr. 15, 1958; U.S. Pat. No. 2,665,685 to Kaufman which issued Jan. 12, 1954; and U.S. Pat. No. 2,109,188 to Bajanova which issued Feb. 22, 1938.

Also typical of the prior art are patents which disclose lifting devices for incapacitated people and requiring no effort on the part of the patient to provide at least some of the lifting force. Some of these are: U.S. Pat. No. 5,187,822 to Merry which issued Feb. 23, 1993; U.S. Pat. No. 4,644,595 to Daniel which issued Feb. 24, 1984; U.S. Pat. No. 3,999,228 to Thomas which issued Dec. 28, 1976; and U.S. Pat. No. 3,711,877 to Averill which issued Jan. 23, 1973.

However, no apparatus is known to the inventor to enable a person to become rehabilitated using a regimen suited to his or her own capabilities and continually adjustable in order to accommodate periodic improvements or even occasional setbacks in the progress of the user. It was with knowledge of the prior art as just described that the present invention was conceived and has now been reduced to practice.

SUMMARY OF THE INVENTION

The present invention relates to a physical rehabilitation system which is provided for improving the capability of a user to support the weight of the user's body on the user's legs or arms, as appropriate. The system comprises a walker frame capable of gliding movement across a surface, upper limb holding members on the walker frame adapted to be gripped by the hands of the user or leaned on with the use of the forearms, and counterbalance weights on the walker frame releasably attachable to the user's body for assistance in lifting the user's body to an upright position. The counterbalance weights may be adjustable according to the need of the user. The width of the walker frame, of the upper limb holding members, and the height of the upper limb holding members are all adjustable to accommodate the size of the user. While the user is provided with a range of freedom with respect to the counterbalance weights, a safety limit is provided for restraining and supporting the user in the event of a fall. The walker frame is preferably of the wheeled variety and selectively operable brake devices are provided at each wheel for holding the walker frame immobile.

The weights employed are intended to counterbalance the weight of the user, although not to totally render the user weightless with respect to his or her limbs, either legs or arms. The number or size of the weights are so chosen by the user or by the user's therapeutic advisor that the user will have to make some effort, even though minimal, to stand erect, then to proceed to walk. As the ability of the user improves, the magnitude of the weights can be reduced.

The system of the invention can selectively be locked in place so the user remains in one location only or the wheels can be unlocked so that the user can move forward, that is, walk at a suitable pace.

The system of the invention is also size adjustable to accommodate a broad range of sizes of users and safety features are provided for the benefit of the user. Additionally, the system of the invention is fully portable, can be easily assembled and disassembled, and can be used safely. It is constructed of commonly available materials and can be readily maintained.

Accordingly, a primary object of the present invention is to provide a rehabilitation system for rehabilitating a person who has experienced, either by accident, by disease, or genetically, a reduction in the normal function of the lower limbs.

Another object of the present invention is to provide such a system which aids the user in efforts to regain the functioning of his or her lower limbs or upper body at a rehabilitation rate chosen by that individual.

A further object of the present invention is to provide such a system which is also of benefit for exercising the back and arms of the user.

Still another object of the invention is to provide a system in which the number or size of the weights may be so chosen by the user or by the user's therapeutic advisor that the user will have to make some effort, even though minimal, to stand erect, then to proceed to walk and such that as the ability of the user improves, the magnitude of the weights can be reduced.

Yet a further object of the present invention is to provide such a system according to which the apparatus can be selectively locked in place so the user remains in one location only or the wheels can be unlocked so that the user may walk at a suitable pace.

Yet another object of the invention is to provide such a system which is size adjustable to accommodate a broad range of sizes of users.

Still a further object of the invention is to provide such a system which is fully portable, can be easily assembled and disassembled, can be used safely, is constructed of commonly available materials, and can be readily maintained.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and together with the description, serve to explain the principles of the invention in general terms. Like numerals refer to like parts throughout the disclosure.

DETAILED DESCRIPTION OF THE PREFERRED EMBODIMENT

Figure 1:
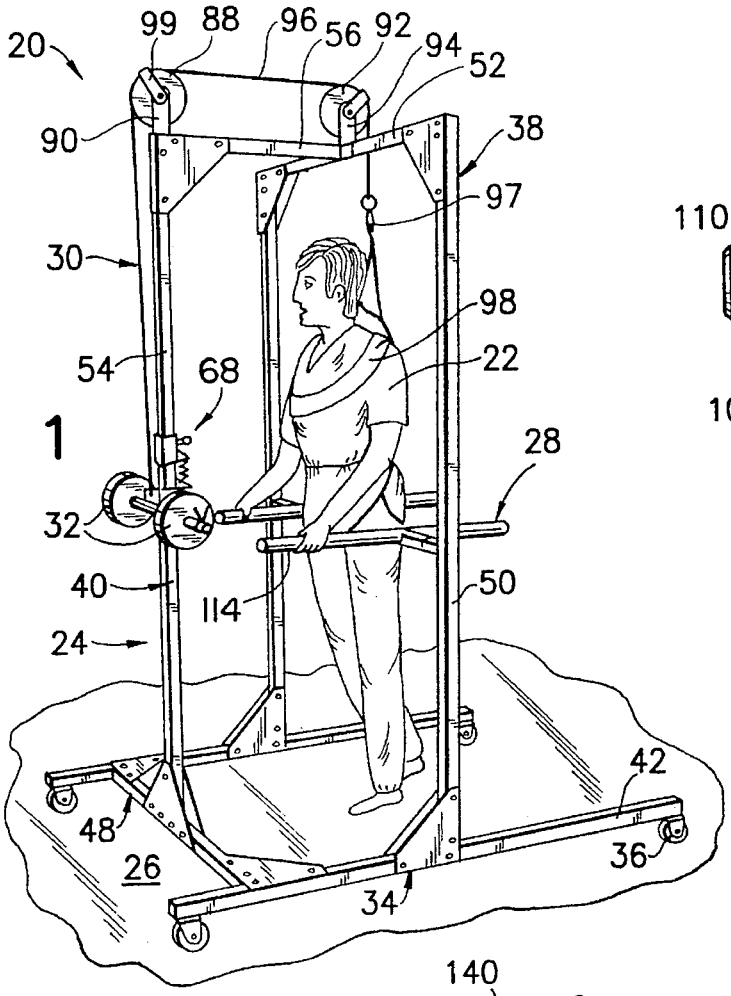
FIG. 1 is a perspective view of a rehabilitation system embodying the present invention and illustrating a user properly positioned to benefit from the invention.
Figure 4:
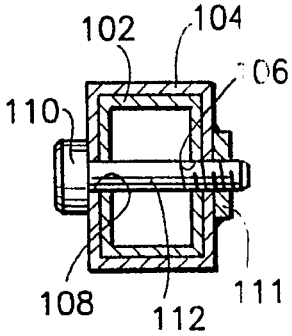
FIG. 4 is a cross section view taken generally along line 4—4 in FIG. 2.
Figure 3:
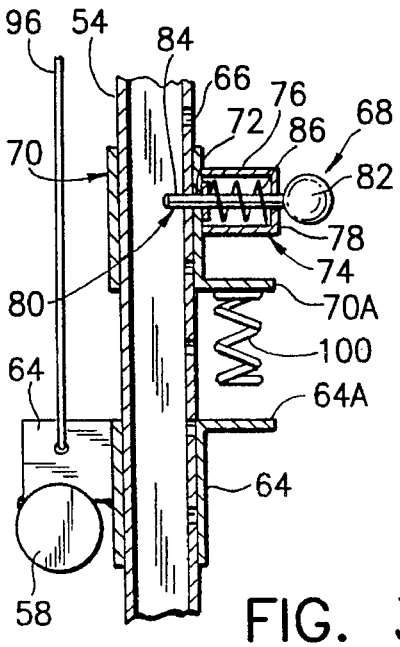
FIG. 3 is a cross section view taken generally along line 3—3 in FIG. 2.
Figures 2, 5:
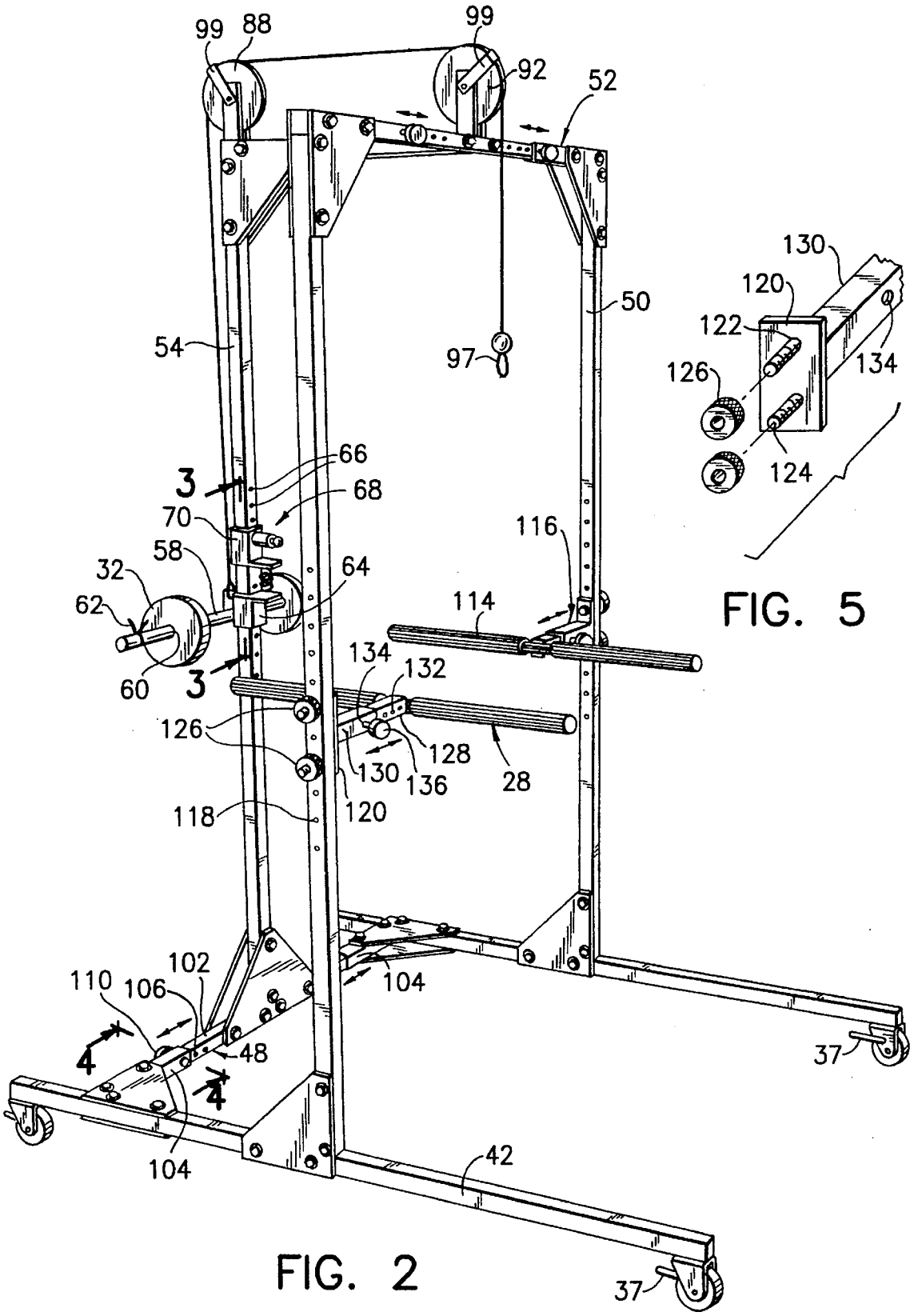
FIG. 2 is an enlarged perspective view of the rehabilitation system illustrated in FIG. 1.
FIG. 5 is a detail perspective exploded view of components illustrated in FIGS. 1 and 2.

Turn now to the drawings and, initially, to FIGS. 1 and 2 which generally illustrate a rehabilitation system 20 embodying the present invention and intended to improve the capability of a user 22 to support the weight of the user's body on the user's legs or arms.

To this end, the system 20 includes a walker frame 24 capable of gliding movement across a surface 26. Upper limb holding members 28 on the walker frame are adapted to be gripped by the hands of the user or leaned upon. Additionally, a counterbalance mechanism 30 is provided on the walker frame which is releasably attachable to the user's body for assistance in lifting the user's body to an upright position. The counterbalance mechanism includes weight members 32 which are selectively weight adjustable according to the need of the user. That is, a range of sizes of the weight members may be selectively employed in a manner to be described in greater detail below.

The walker frame 24 includes a base 34 and a plurality of wheel members 36 supporting the base for rolling movement across the surface 26. Preferably, each of the wheel members 36 includes a suitable brake device which is selectively operable by means of a locking lever 37 for holding the walker frame immobile on the surface 26.

A coronal frame 38 is mounted on the base 34 and is upstanding from the base and is generally coplanar with the coronal plane of the user. Thus, the coronal frame 38 generally encompasses the user when the user assumes an upright position.

In a somewhat similar fashion, a medial frame 40 is mounted on the base 34, upstanding therefrom, and is generally coplanar with the medial plane of the user when the user assumes an upright position. The medial frame 40 extends between and is integral with both the base 34 and with the coronal frame 38.

The base 34 includes a pair of generally parallel spaced apart support beams 42 extending longitudinally between forward and rearward ends, 44 and 46, respectively. A cross support beam 48 extends transversely of the parallel support beams 42 and is attached at its opposite ends to the parallel support beams, respectively, at locations intermediate the forward and rearward ends 44, 46.

The coronal frame 38 is of generally inverted U-shape and includes a pair of generally parallel spaced apart upright posts 50 having bases mounted, respectively, to the support beams 42 intermediate the forward and rearward ends 44, 46 and an upper cross beam 52 integral with and extending between the upright posts 50 at locations distant from the support beams 42.

The medial frame 40 is generally of an inverted L-shape and includes an erect member 54 attached at its lower end to the cross support beam 48 intermediate the parallel support beams 42 and a strut member 56 joining the erect member at a location distant from the cross support beam with the upper cross beam 52.

The counterbalance mechanism 30 includes a support bar 58 for removably receiving the weight members 32 thereon. In a typical construction, but not limiting of the invention, the weight members 32 may be disk shaped, each with a centrally positioned mounting hole 60 of sufficient size to enable its slidable reception onto the support bar. Once a weight member 32 is positioned on the support bar 58, a spring biased clamp 62 or other suitable locking device may be applied to the support bar outboard of the weight member to retain the weight member positioned thereon.

A trolley block 64 is slidably engaged with the erect member 54 for movement along the length of the erect member. The support bar 58 is fixed, as by welding, to the trolley block and projects transversely of the plane of the medial frame 40 in opposite directions thereby defining left hand and right hand weight receiving portions, respectively. The weight members 32 are slidably receivable on the left hand portion and on said right hand portion, respectively.

The erect member 54 has a plurality of longitudinally spaced apertures 66 which extend therethrough. A stop mechanism 68 is provided on the erect member 54 for limiting upward movement of the trolley block 64, being selectively engageable with any one of the longitudinally spaced apertures 66 to thereby define a stop location beyond which the trolley block cannot slide. More specifically, the stop mechanism 68 includes a slider 70 which is slidably engaged with the erect member 54 for movement along the length of the erect member between the base 34 and the strut member 56. The slider 70 has a lateral throughbore 72 aligned with the longitudinally spaced apertures 66 in the erect member. A cup-shaped housing 74 is fixed on the slider and has a sidewall 76 projecting away from the erect member 54 and a centrally apertured cap 78.

A plunger 80 having a handle 82 external of the cup-shaped housing 74 and a rod 84 integral with the handle projects through the aperture in the cap 78 and through the lateral throughbore 72 in the erect member 54 aligned with the longitudinally spaced apertures 66. A tension spring 86 within the cup-shaped housing is coaxially positioned with respect to the plunger. One end of the tension spring 86 is engaged with the rod 84 and the other end is engaged with the base. The tension spring thereby operates to urge the rod toward the erect member 54. With this construction, the rod 84 is engageable with any one of the longitudinally spaced apertures 66 in the erect member 54 whenever the slider 70 is positioned such that the rod is properly aligned.

To conclude the description of the counterbalance mechanism 30, a forward pulley 88 is rotatably mounted on a yoke 90 fixed to the strut member 56 and an aft pulley 92 is rotatably mounted on a yoke 94 fixed to the upper cross beam 52. The forward and aft pulleys are coplanar with the medial frame. An elongate cable member 96 is attached at one end to the trolley block 64 integral with the support bar 58 and at the other end is releasably attached, as by a suitable clasp 97, to a suitable harness 98 worn by the user. In traveling between the trolley block 64 and the harness 98, the cable member 96 is engageably guided over and around the forward and aft pulleys 88, 90 by means of suitable guides 99.

Should the user slip or fall while using the system 20, the trolley block 64 will tend to ascend the erect member 54 at a rapid rate, then be stopped abruptly by the stop mechanism 68. In order to absorb some of the impact between the trolley block and the slider 70, the stop mechanism 68 includes a resilient member, such as spring 100, positioned to engage the trolley block as the trolley block approaches the stop mechanism. The spring 100 is illustrated as being fixed, as by welding, to an outwardly extending flange 70A integral with the slider 70 and aligned for engagement with an outwardly extending flange 64A integral with the trolley block 64.

Because potential users of the rehabilitation system 20 are known to be of a wide variety of sizes, it is highly desirable for the walker frame 24 to be adjustable to accommodate all possible users. To this end, the cross support beam 48 includes first and second tubular, slidably engaged, telescoping members 102, 104, respectively. The telescoping member 102 is slidably received inside the telescoping member 104 and has a plurality of pairs of longitudinally spaced apertures 106 therein. The telescoping member 104 has a pair of mutually aligned apertures 108 therein also aligned with the plurality of pairs of longitudinally spaced apertures 106 in the telescoping member 102. A suitable fastener is then used to hold the telescoping members 102, 104 relatively fixed. Such a fastener may include a bolt 110 including a shank 112 extending through selected pairs of apertures 106 in the telescoping member 102 and through the apertures 108 in the telescoping members 104 and threadedly engaged with a nut 111.

A similar construction may be provided for the upper cross beam 52. However, since it is similar, it is not deemed necessary to describe that construction in detail. Similarly, the upright posts 50 and erect member 54 may also be of telescoping construction to accommodate users of different heights.

It was previously mentioned that the rehabilitation system is provided with upper limb holding members 28 to enable the user to achieve and maintain an erect position. The upper limb holding members 28 include left and right spaced apart elongated handles 114 which extend generally parallel to each of the support beams 42 of the base 34. A pair of (left and right) transverse support bars 116 serve to mount the right and left handles, respectively, on the upright posts 50 at locations intermediate the base 34 and the upper cross beam 52.

The handles 114 are adjustable both in elevation and widthwise to accommodate a range of sizes of users of the rehabilitation system 20. As to the former, each of the upright posts 50 has a plurality of longitudinally spaced apertures 118 therein. Mounts for each transverse support bar 116 include an elongated mounting plate 120 fixed to one end of the left and right support bars 116 and lying in a plane perpendicular thereto. Viewing FIG. 5, the mounting plate 120 has a pair of spaced apart holes 122 therethrough capable of alignment with a plurality of pairs of the spaced apertures 118 in the upright posts 50 when the mounting plate is positioned proximate to the associated upright post 50.

A suitable fastener such as a bolt 124 is receivable through the spaced apart holes 122 in the mounting plate 120, through selected pairs of the spaced apart apertures 118 in the upright posts 50, then threadedly attached to nuts 126 for securing the mounting plate to the upright member.

In keeping with the intent of the invention to assure that the rehabilitation system is widely available for substantially all users, the transverse support bars 116 are constructed to be adjustable transverse-wise to accommodate the breadth of the user. To this end, each of the transverse support bars 116 includes first and second tubular slidably engaged telescoping members 128, 130, generally similar in construction to the telescoping members 104, 106. As in the earlier described construction, the first telescoping member 128 has a plurality of pairs of longitudinally spaced apertures 132 therein and the second telescoping member 130 (see FIG. 5) has a pair of mutually aligned apertures 134 therein also aligned with the plurality of pairs of the longitudinally spaced apertures 132. Again, a suitable fastener 136 is receivable through selected pairs of the apertures 132 in the first telescoping member 128 and through the apertures 134 in the second telescoping member for holding the telescoping members relatively fixed. In this manner, the user can select a desired spacing between the handles 114; then make the necessary adjustments.

It will be appreciated that a more rigid construction of the upper limb holding members 28 may be desirable than that illustrated. Indeed, this comment is applicable to all of the other components comprising the invention. Thus, the illustrations are for purposes of explanation and an actual rehabilitation system 20 may be much more rigidly constructed.

In operation, initially, the user would likely be seated in a wheel chair (not shown). The wheels 36 of the rehabilitation system 20 would likely be locked, then the wheel chair moved to a location between the support beams 42 and generally in the region of the coronal frame 38. At an earlier time, size adjustments as earlier described will have been made to accommodate the current user. Proper sized weights 32 will have been mounted on the support bar 58 by the user or by the therapeutic advisor. The clasp 98 at the end of the cable member 96 is then attached to the harness 99 worn by the user. Thereupon, the user grips the handles 114 and, with the assistance provided by the weights 32, pulls himself or herself up to a standing, or erect, position as indicated in FIG. 1. At this point, the wheels 36 may be unlocked by the therapeutic advisor and the user can proceed to walk forward. The user may continue to grip the handles 114 with both hands throughout the walking process when the wheels are unlocked. Alternatively, even with the wheels locked, the user is able to walk for a short distance within the system 20 by reason of the length of the handles 114, moving one hand forward at a time while transferring weight to the other hand.

Should the user slip or fall, the stop mechanism is suitably positioned on the erect member 54 so that the resulting upward movement of the trolley block 64 is quickly arrested. The user is prevented from falling onto the surface 26 by the harness 99 and cable member 96 and is held until assistance can be provided or until the user can recover by himself or herself.

As the legs of the user become stronger, the magnitude of the weights 32 used can be reduced; alternatively, should the user suffer a relapse, the magnitude of the weights can be increased once again. Hence, the system 20 not only accommodates all sizes of users but all stages of rehabilitation as well.

Figure 6:
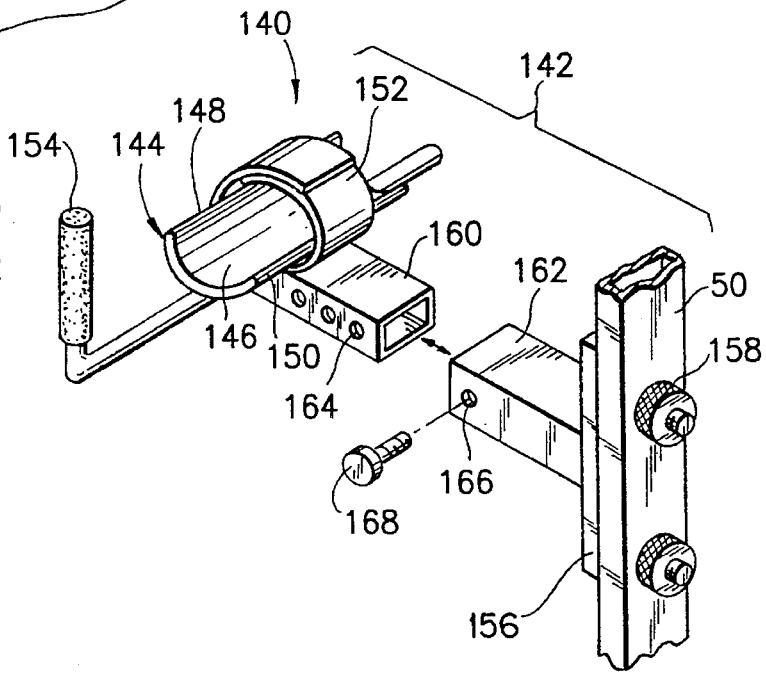
FIG. 6 is a detail perspective exploded view of another embodiment of the invention.

Turn now to FIG. 6, especially, for the description of another embodiment of the invention. Modified upper limb holding members include left and right spaced apart forearm crutches 140 which, in the manner of the handles 114, extend generally parallel to each of the support beams 42 of the base 34. Left and right transverse support bars 142 are employed for mounting the right and left forearm crutches 140, respectively, on the upright posts 50 at locations intermediate the base 34 and the upper cross beam 52.

Each of the forearm crutches 140 includes an elongated brace 144 having an upward facing trough 146 defined by opposed parallel spaced apart edges 148, 150 adapted to receive the forearm of a user. A suitable releasable two-piece strap construction 152 using hook and loop fasteners or other appropriate fastening components are mounted on the elongated brace 144 and extend between and across the edges 148, 150 and across the trough 146 for firmly engaging and holding an arm of the user. Cooperating with the brace 144 is an integral handle 154 mounted on the brace and spaced from the trough 146 and adapted to be gripped by the hand of the user.

It was previously explained that each of the upright posts 50 has a plurality of longitudinally spaced apertures 118 therein. Provision is made for mounting the forearm crutches on the upright posts at a proper elevation to accommodate the user. In this instance, the mounting mechanism includes an elongated mounting plate 156 fixed to one end of the left and right transverse support bars 142 and lying in a plane perpendicular thereto. As with the mounting plate 120, the mounting plate 156 has a pair of spaced apart holes therethrough capable of alignment with a plurality of pairs of the spaced apertures 118 in the upright posts 50 when the plate is positioned proximate thereto. Then, suitable fasteners 158 are receivable through the spaced apart holes in the mounting plate and through selected pairs of the spaced apart apertures 118 for securing the mounting plate to the upright post.

Each of the transverse support bars 142 includes first and second tubular slidably engaged telescoping members 160, 162, respectively. As with the support bar 116, the telescoping member 160 has a plurality of pairs of longitudinally spaced apertures 164 therein and the telescoping member 162 has a pair of mutually aligned apertures 166 therein also aligned with the plurality of pairs of longitudinally spaced apertures 164. Again, a suitable fastener device 168 is receivable through selected pairs of the apertures 164 and through the apertures 166 for holding the telescoping members 160, 162 relatively fixed. In this manner, a desired width or separation between the opposed forearm crutches can be selected and retained for so long as is needed by a particular user.

The construction illustrated in FIG. 6 may be used by a person with limited lower limb capability and provides the user with an opportunity to strengthen muscles in the upper limbs and upper body in general. In all other respects, rehabilitation system, so modified, operates as previously.

While preferred embodiments of the invention have been disclosed in detail, it should be understood by those skilled in the art that various other modifications may be made to the illustrated embodiments without departing from the scope of the invention as described in the specification and defined in the appended claims.

What is claimed is:

1. A physical rehabilitation system for improving the capability of a user to support the weight of the user's body on the user's limbs, said system comprising:

a walker frame including a base including a pair of generally parallel spaced apart support beams extending longitudinally between forward and rearward ends and a cross support beam extending transversely of said parallel support beams and attached at its opposite ends, respectively, to said parallel support beams intermediate said forward and rearward ends, wheel members supporting the base for rolling movement across a surface, a coronal frame mounted on said base and upstanding therefrom and being generally coplanar with the coronal plane of the user when using said system and generally encompassing the user When the user assumes an upright position, said coronal frame being of generally inverted U-shape including a pair of generally parallel spaced apart upright posts having bases mounted, respectively, to said support beams intermediate said forward and rearward ends and an upper cross beam integral with and extending between said upright posts at locations distant from said support beams, and a medial frame mounted on said base and upstanding therefrom and being generally coplanar with the medial plane of the user when the user assumes an upright position, said media frame being integral with both said base and said coronal frame, said medial frame being of a generally inverted L-shape including an erect member having a plurality of longitudinally spaced apertures therein attached at its lower end to said cross support beam intermediate said parallel support beams and a strut member joining said erect member at a location distant from said cross support beam with said upper cross beam;

upper limb holding members on said walker frame adapted for engagement by the hands or arms of the user; and counterbalance means slidably movable on said walker frame between spaced apart limit means and releasably attachable to the user's body for assistance in lifting the user's body to an upright position, said counterbalance means including weight members which are selectively weight adjustable according to the need of the user, a support bar for removably receiving said weight members thereon, a first pulley rotatably mounted on said strut member, a second pulley rotatably mounted on said upper cross beam, said first and second pulleys being coplanar with said medial frame, an elongate cable member extending between and attached, respectively, to said support bar and to the user's body and engageably guided over and around said first and second pulleys, and a trolley block slidably engaged with said erect member for movement along the length thereof, said support bar being fixed thereto and projecting transversely of the plane of said medial frame in opposite directions therefrom thereby defining left hand and right hand weight receiving portions, respectively, said weight members being slidably receivable on said left hand portion and on said right hand portion, respectively; and a stop mechanism for limiting upward movement of said trolley block being selectively engageable with any one of the longitudinally spaced apertures to thereby define a stop location beyond which said trolley block cannot slide, said stop mechanism including a slider slidably engaged with said erect member for movement along the length thereof, said slider having a lateral throughbore aligned with the longitudinally spaced apertures in said erect member, a cup-shaped housing mounted on said slider and having a sidewall projecting away from said erect member and a centrally apertured base, a plunger having a handle external of said cup-shaped housing and a rod integral with said handle projecting through the aperture in said base and through the lateral throughbore in said erect member aligned with the longitudinally spaced apertures, a tension spring within said cup-shaped housing coaxially positioned with respect to said plunger, one end thereof being engaged with said rod, the other end thereof being engaged with said base for urging said rod toward said erect member, whereby said rod is engageable with any one of the longitudinally spaced apertures in said erect member whenever said slider is positioned such that said rod is aligned therewith.

2. A physical rehabilitation system as set forth in claim 1 wherein said stop mechanism includes a resilient member positioned to engage said trolley block as said trolley block approaches said stop mechanism.

3. A physical rehabilitation system as set forth in claim 1 including:

selectively operable brake means at each of said wheel members for holding said walker frame immobile on the surface.

4. A physical rehabilitation system as set forth in claim 1 including:

wherein said cross support beam and said upper cross beam each includes first and second tubular slidably engaged telescoping members;

wherein said first telescoping member has a plurality of pairs of longitudinally spaced apertures therein;

wherein said second telescoping member has a pair of mutually aligned apertures therein also aligned with the plurality of pairs of longitudinally spaced apertures in said first telescoping member; and fastener means receivable through selected pairs of apertures in said first telescoping member and through the apertures in said second telescoping members for holding said first and second telescoping members relatively fixed.

5. A physical rehabilitation system as set forth in claim 1 wherein said upper limb holding members include:

left and right spaced apart elongated handles extending generally parallel to each of said support beams of said base; and left and right transverse support bars for mounting said right and left handles, respectively, on said upright posts at locations intermediate said base and said upper cross beam.

6. A physical rehabilitation system as set forth in claim 5 including:

mounting means for adjustably attaching said left and right support bars on said upright posts at an elevation to accommodate the user.

7. A physical rehabilitation system as set forth in claim 6 wherein each of said upright posts has a plurality of longitudinally spaced apertures therein; and wherein said mounting means includes:

an elongated mounting plate fixed to one end of said left and right support bars and lying in a plane perpendicular thereto, said mounting plate having a pair of spaced apart holes therethrough capable of alignment with a plurality of pairs of the spaced apertures in said upright posts when said plate is positioned proximate to said associated upright member; and fastener means receivable through the spaced apart holes in said mounting plate and through selected pairs of the spaced apart apertures in said upright posts for securing said mounting plate to said upright member.

8. A physical rehabilitation system as set forth in claim 5 including means for adjusting the length of said transverse support bars transversely of the plane of said medial frame to accommodate the breadth of the user.

9. A physical rehabilitation system as set forth in claim 5 wherein said transverse support bars each includes first and second tubular slidably engaged telescoping members;

wherein said first telescoping member has a plurality of pairs of longitudinally spaced apertures therein;

wherein said second telescoping member has a pair of mutually aligned apertures therein also aligned with the plurality of pairs of longitudinally spaced apertures in said first telescoping member; and fastener means receivable through selected pairs of apertures in said first telescoping member and through the apertures in said second telescoping members for holding said first and second telescoping members relatively fixed.

10. A physical rehabilitation system as set forth in claim 1 including:

wherein said upper limb holding members include:

left and right spaced apart forearm crutches extending generally parallel to each of said support beams of said base; and left and right transverse support bars for mounting said right and left forearm crutches, respectively, on said upright posts at locations intermediate said base and said upper cross beam.

11. A physical rehabilitation system as set forth in claim 10 wherein each of said forearm crutches includes:

an elongated brace having an upward facing trough defined by opposed parallel spaced apart edges adapted to receive the forearm of a user; and releasable strap means mounted on said elongated brace and extending between said edges and across said trough for firmly engaging and holding an arm of the user; and an integral handle mounted on said brace and spaced from said trough and adapted to be gripped by the hand of the user.

12. A physical rehabilitation system as set forth in claim 11 including mounting means for adjustably attaching said left and right support bars on said upright posts at an elevation to accommodate the user; and means for adjusting the length of said transverse support bars transversely of the plane of said medial frame to accommodate the breadth of the user.

13. A physical rehabilitation system as set forth in claim 12 wherein each of said upright posts has a plurality of longitudinally spaced apertures therein; and wherein said mounting means includes:

an elongated mounting plate fixed to one end of said left and right support bars and lying in a plane perpendicular thereto, said mounting plate having a pair of spaced apart holes therethrough capable of alignment with a plurality of pairs of the spaced apertures in said upright posts when said plate is positioned proximate to said associated upright member;

fastener means receivable through the spaced apart holes in said mounting plate and through selected pairs of the spaced apart apertures in said upright posts for securing said mounting plate to said upright member;

wherein said transverse support bars each includes first and second tubular slidably engaged telescoping members;

wherein said first telescoping member has a plurality of pairs of longitudinally spaced apertures therein;

wherein said second telescoping member has a pair of mutually aligned apertures therein also aligned with the plurality of pairs of longitudinally spaced apertures in said first telescoping member; and fastener means receivable through selected pairs of apertures in said first telescoping member and through the apertures in said second telescoping members for holding said first and second telescoping members relatively fixed.

14. A physical rehabilitation system for improving the capability of a user to support the weight of the user's body on the user's limbs, said system comprising:

a walker frame including abase including a pair of generally parallel spaced apart support beams extending longitudinally between forward and rearward ends and a cross support beam extending transversely of said parallel support beams and attached at its opposite ends, respectively, to said parallel support beams intermediate said forward and rearward ends, wheel members supporting the base for rolling movement across a surface, a coronal frame mounted on said base and upstanding therefrom and being generally coplanar with the coronal plane of the user when using said system and generally encompassing the user when the user assumes an upright position, said coronal frame being of generally inverted U-shape including a pair of generally parallel spaced apart upright posts having a plurality of longitudinally spaced apertures therein and having bases mounted, respectively, to said support beams intermediate said forward and rearward ends and an upper cross beam integral with and extending between said upright posts at locations distant from said support beams, and a medial frame mounted on said base and upstanding therefrom and being generally coplanar with the medial plane of the user when the user assumes an upright position, said medial frame being integral with beth said base and said coronal frame, said medial frame being of a generally inverted L-shape including an erect member attached at its lower end to said cross support beam intermediate said parallel support beams and a strut member joining said erect member at a location distant from said cross support beam with said upper cross beam;

upper limb holding members on said walker frame adapted for engagement by the hands or arms of the user including left and right spaced apart elongated handles extending generally parallel to each of said support beams of said base and left and right transverse support bars for mounting said right and left handles, respectively, on said upright posts at locations intermediate said base and said upper cross beam;

counterbalance means slidably movable on said walker frame between spaced apart limit means and releasably attachable to the user's body for assistance in lifting the user's body to an upright position, said counterbalance means including weight members which are selectively weight adjustable according to the need of the user; and mounting means for adjustably attaching said left and right support bars on said upright posts at an elevation to accommodate the user including an elongated mounting plate fixed to one end of said left and right support bars and lying in a plane perpendicular thereto, said mounting plate having a pair of spaced apart holes therethrough capable of alignment with a plurality of pairs of the spaced apertures in said upright posts when said plate is positioned proximate to said associated upright member and fastener means receivable through the spaced apart holes in said mounting plate and through selected pairs of the spaced apart apertures in said upright pests for securing said mounting plate to said upright member.

15. A physical rehabilitation system as set forth in claim 14 wherein said counterbalance means includes:

a support bar for removably receiving said weight members thereon;

a first pulley rotatably mounted on said strut member;

a second pulley rotatably mounted on said upper cross beam;

said first and second pulleys being coplanar with said medial frame; and an elongate cable member extending between and attached, respectively, to said support bar and to the user's body and engageably guided over and around said first and second pulleys.

16. A physical rehabilitation system as set forth in claim 15 wherein said counterbalance means includes:

a trolley block slidably engaged with said erect member for movement along the length thereof, said support bar being fixed thereto and projecting transversely of the plane of said medial frame in opposite directions therefrom thereby defining left hand and right hand weight receiving portions, respectively, said weight members being slidably receivable on said left hand portion and on said right hand portion, respectively.

17. A physical rehabilitation system as set forth in claim 16 wherein said erect member has a plurality of longitudinally spaced apertures therein;

said system including:

a stop mechanism for limiting upward movement of said trolley block being selectively engageable with any one of the longitudinally spaced apertures to thereby define a stop location beyond which said trolley block cannot slide.

18. A physical rehabilitation system as set forth in claim 17 wherein said stop mechanism includes:

a slider slidably engaged with said erect member for movement along the length thereof, said slider having a lateral throughbore aligned with the longitudinally spaced apertures in said erect member;

a cup-shaped housing mounted on said slider and having a sidewall projecting away from said erect member and a centrally apertured base;

a plunger having a handle external of said cup-shaped housing and a rod integral with said handle projecting through the aperture in said base and through the lateral throughbore in said erect member aligned with the longitudinally spaced apertures;

a tension spring within said cup-shaped housing coaxially positioned with respect to said plunger, one end thereof being engaged with said rod, the other end thereof being engaged with said base for urging said rod toward said erect member;

whereby said rod is engageable with any one of the longitudinally spaced apertures in said erect member whenever said slider is positioned such that said rod is aligned therewith.

19. A physical rehabilitation system for improving the capability of a user to support the weight of the user's body on the user's limbs, said system comprising:

a walker frame including a base including a pair of generally parallel spaced apart support beams extending longitudinally between forward and rearward ends and a cross support beam extending transversely of said parallel support beams and attached at its opposite ends, respectively, to said parallel support beams intermediate said forward and rearward ends, wheel members supporting the base for rolling movement across a surface, a coronal frame mounted on said base and upstanding therefrom and being generally coplanar with the coronal plane of the user when using said system and generally encompassing the user when the user assumes an upright perdition, said coronal frame being of generally inverted U-shape including a pair of generally parallel spaced apart upright posts having a plurality of longitudinally spaced apertures therein and having bases mounted, respectively, to said support beams intermediate said forward and rearward ends and an upper cross beam integral with and extending between said upright pests at locations distant from said support beams, and a medial frame mounted on said base and upstanding therefrom and being generally coplanar with the medial plane of the user when the user assumes an upright position, said medial frame being integral with beth said base and said coronal frame, said medial frame being of a generally inverted L-shape including an erect member attached at its lower end to said cross support beam intermediate said parallel support beams and a strut member joining said erect member at a location distant from said cross support beam with said upper cross beam;

upper limb holding members on said walker frame adapted for engagement by the hands or arms of the user including left and right spaced apart forearm crutches extending generally parallel to each of said support beams of said base and left and right transverse support bars for mounting said right and left forearm crutches, respectively, on said upright pests at locations intermediate said base and said upper cross beam, each of said forearm crutches including an elongated brace having an upward facing trough defined by opposed parallel spaced apart edges adapted to receive the forearm of a user, releasable strap means mounted on said elongated brace and extending between said edges and across said trough for firmly engaging and holding an arm of the user, and an integral handle mounted on said brace and spaced from said trough and adapted to be gripped by the hand of the user;

counterbalance means slidably movable on said walker frame between spaced apart limit means and releasably attachable to the user's body for assistance in lifting the user's body to an upright position, said counterbalance means including weight members which are selectively weight adjustable according to the need of the user; and mounting means for adjustably attaching said left and right support bars on said upright posts at an elevation to accommodate the user and means for adjusting the length of said transverse support bars transversely of the plane of said medial frame to accommodate the breadth of the user, said mounting means including an elongated mounting plate fixed to one end of said left and right support bars and lying in a plane perpendicular thereto, said mounting plate having a pair of spaced apart holes therethrough capable of alignment with a plurality of pairs of the spaced apertures in said upright posts when said plate is positioned proximate to said associated upright member, fastener means receivable through the spaced apart holes in said mounting plate and through selected pairs of the spaced apart apertures in said upright posts for securing said mounting plate to said upright member, wherein said transverse support bars each includes first and second tubular slidably engaged telescoping members, wherein said first telescoping member has a plurality of pairs of longitudinally spaced apertures therein, wherein said second telescoping member has a pair of mutually aligned apertures therein also aligned with the plurality of pairs of longitudinally spaced apertures in said first telescoping member and fastener means receivable through selected pairs of apertures in said first telescoping member and through the apertures in said second telescoping members for holding said first and second telescoping members relatively fixed.

20. A physical rehabilitation system as set forth in claim 19 wherein said counterbalance means includes:

a support bar for removably receiving said weight members thereon;

a first pulley rotatably mounted on said strut member;

a second pulley rotatably mounted on said upper cross beam;

said first and second pulleys being coplanar with said medial frame; and an elongate cable member extending between and attached, respectively, to said support bar and to the user's body and engageably guided over and around said first and second pulleys.

* * * * *